US005305962A

United States Patent [19]

Uehara

[11] Patent Number: 5,305,962

[45] Date of Patent: Apr. 26, 1994

[54] YARN WINDING APPARATUS AND METHOD

[75] Inventor: Masao Uehara, Kyoto, Japan

[73] Assignee: Murata Kikai Kabushiki Kaisha, Kyoto, Japan

[21] Appl. No.: 900,912

[22] Filed: Jun. 18, 1992

[30] Foreign Application Priority Data

Jun. 19, 1991 [JP] Japan ..... 3-176177
Aug. 27, 1991 [JP] Japan ..... 3-240502

[51] Int. Cl.[5] ..... B65H 54/28

[52] U.S. Cl. ..... 242/43.2; 242/43.1; 57/127.5; 57/281

[58] Field of Search ..... 242/43.2, 43 R, 43.1

[56] References Cited

U.S. PATENT DOCUMENTS 2,147,212 2/1939 Parks ..... 242/43.2
5,065,950 11/1991 Otoshima ..... 242/43.2

FOREIGN PATENT DOCUMENTS 402849 3/1943 France ..... 242/43.2

*Primary Examiner*—Stanley N. Gilreath
*Attorney, Agent, or Firm*—Spensley Horn Jubas & Lubitz

[57] ABSTRACT

A winding method for winding a yarn by mounting and removing a defining guide on and from a yarn guide of a drum winder, wherein the defining guide defines a movement of a yarn in one direction according to a winding width and the drum winder has a normal traverse drum and a yarn guide provided at the section via which the yarn is fed to the traverse drum.

6 Claims, 7 Drawing Sheets

YARN WINDING APPARATUS AND METHOD

BACKGROUND OF THE INVENTION

1. Field of the Invention

This invention relates to a method for winding a yarn on a bobbin while being traversed by a traverse drum.

2. Prior Art

A cone, wound by a drum winder for winding a cone, is of the size of 6 inches, being the standard size in widest use. For example, in the case where it is used for a supply of yarn in a double twister, when two cones of 6 inch long are superposed, the yarn tension generated by ballooning of yarn (when unwound from a yarn guide above a spindle via a yarn guide tube which is radially formed in the storage portion and which passed through the spindle) is very large, 80 to 100 g. Therefore, in case of fine yarn of which yarn strength is only 50 to 60 g, yarn breakages occur. Therefore, for the supply of yarn in a double twister, a cone of 4 inches in normally formed.

An apparatus for winding cones having different winding widths and using one and the same drum winder has been known (Japanese Patent Laid Open No. 143873/1991 publication).

The above-described apparatus has a member which moves in and out of a traverse groove of a traverse drum to change a traverse width so that when the traverse width changing member is moved into the traverse groove, a defining guide for defining a movement of yarn to the side end of the traverse width changing member among yarn traverse directions is mounted on the yarn guide provided at the section via which the yarn is fed to the traverse drum.

Where the traverse width changing member is moved into the traverse groove by the aforesaid apparatus, and the traverse width is defined to be smaller by the yarn guide defining guide, if the yarn is to be wound, this has the disadvantage in that stitching (i.e., yarn which is dropped from an end of a package and is wound on the end face of a package) still occurs at the end of the small diameter side of the cone.

OBJECT AND SUMMARY OF THE INVENTION

It is an object of the present invention to provide a winding method in which winding cones have different winding widths using one and the same drum winder, and a yarn is wound so as not to produce stitching even when a cone having a small winding width is formed.

For achieving the aforesaid object, this invention provides a winding method for winding a yarn by mounting and removing a defining guide on and from the yarn guide of a drum winder, said defining guide defining the movement of a yarn in one direction according to a winding width, said drum winder having a normal traverse drum and a yarn guide provided at the section via which the yarn is fed to the traverse drum.

In the thus configured winding method, when the defining guide is mounted on the yarn guide, the movement of the yarn to be wound in one direction of the traverse is defined by the defining guide, and a package having a small winding width is formed. On the other hand, when the defining guide is not mounted on the yarn guide, the yarn to be wound is traversed all over the width of the yarn guide, and a package having a large winding width is formed.

BRIEF DESCRIPTION OF THE DRAWINGS

FIG. 6*a b* is a view showing an example of a package winding-width detecting device having two photoelectric switches.

DETAILED DESCRIPTION OF PREFERRED EMBODIMENT

An embodiment of a winding method according to this invention will be described hereinbelow with reference to FIGS. 1 and 2.

In this winding method, a defining guide 14 for defining a moving width of a yarn in one direction according to a winding width is mounted on and removed from a yarn guide 6 of a drum winder having a normal traverse drum 2 and a yarn guide to separately wind packages having different winding widths.

Figure 1:
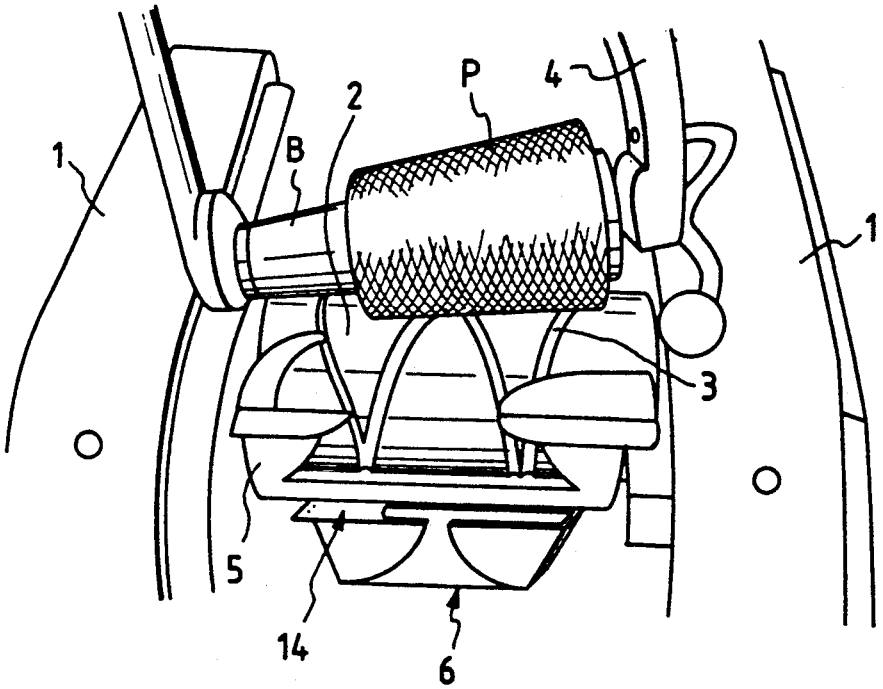
FIG. 1 is a perspective view of essential parts of a drum winder unit used in carrying out the winding method according to this invention.
Figure 2:
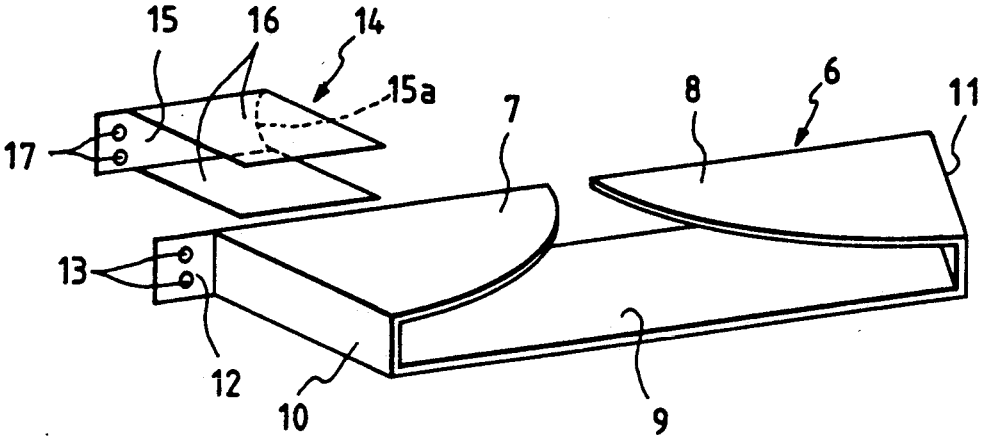
FIG. 2 is an exploded perspective view of a yarn guide and a defining guide.

FIG. 1 shows a winding unit of a drum winder, in which a traverse drum 2 is disposed above a frame body 1 of the unit. On this side of the traverse drum 2 is provided an anti-yarn breakage plate 5 for preventing a yarn from flying out of a groove 3 of the traverse drum 2 when a yarn is wound on a conical bobbin B supported on a cradle 4. A yarn guide 6 is secured below the anti-yarn breakage plate 5.

The yarn guide 6 is secured to the frame body 1 of the unit by a bracket (not shown), and front guide plates 7 and 8, and a rear guide plate 9 and both side plates 10 and 11 are built as one unit. The yarn traverses and runs through a space surrounded by said elements. This space is enlarged from a yarn inlet side to a yarn outlet side, that is, from a lower portion to an upper portion and has a complicated construction. However, the detailed construction is omitted since it has no relation with this invention.

A defining guide 14 is composed of an upper plate 15 having a bolt insert hole 17 on one end and formed on the other end with a recess 15*a*, and side plates 16 formed integrally on opposite sides, the defining guide 14 being detachably mounted on a mounting portion 12 on the left end above the yarn outlet side of the yarn guide 6. When a cone having a small winding width is formed, bolts are inserted into the bolt insert hole 17 of the defining guide 14 and a bolt insert hole 13 bored in the mounting portion 12 of the yarn guide and then tightened whereby the defining guide 14 is mounted on the yarn guide 6, in which state winding takes place. It is to be noted that when the defining guide 14 is mounted on the yarn guide 6, the side plates 16 and 16 cover the front guide plate 7 or the rear guide plate 9 of the yarn guide 6 from outside.

When winding takes place while the defining guide 14 is mounted on the yarn guide 6 as described above, the traverse is defined by the recess 15*a* of the upper plate 15 of the defining guide 14 to form a package P having a small winding width. Of course, when the defining guide 14 is not mounted on the yarn guide 6, a normal 6-inch wide package P is formed. It is to be noted that the groove 3 of the traverse drum 2 is properly provided whereby two kinds of packages P can be obtained as desired.

The relationship between the mounting position of the defining guide 14 (a position from the left end of the yarn guide 6 of the recess 15*a*) and the traverse width of yarn in a 6-inch wide traverse drum of various winding numbers (number of revolutions of the traverse drum required to traverse the yarn once) will be described hereinafter.

In case of a 2-wind traverse drum, when the recess 15*a* is placed at a position of 4-inch, it corresponds to that of a package which is wound in traverse width of 102 mm by a traverse drum of 1.5 wind. In case of a 2.5-wind traverse drum, when the recess 15*a* is placed at a position of 4.25-inch, it corresponds to that of a package which is wound in traverse width of 108 mm by a 2-wind traverse drum. In case of a 3-wind traverse drum, when the recess 15*a* is placed at a position of 4.25-inch, it corresponds to that of a package which is wound in traverse width of 114 mm by a 2-wind traverse drum. In case of a 3-wind traverse drum, when the recess 15*a* is placed at a position of 3.5-inch, it corresponds to that of a package which is wound in traverse width of 86 mm by a 2-wind traverse drum.

Since this invention is configured as described above, the following effects are obtained.

A simple defining guide is merely mounted and removed whereby cones having different winding widths can be separately wound using one and the same drum winder, and in addition, even when a cone having a small winding width is formed, a package which is smooth at the end without stitching can be formed as compared with prior art which is provided with a traverse width changing member moved in and out of the traverse groove of the traverse drum and a defining guide. Of course, this invention is superior to that having a traverse width changing member alone. Moreover, defining guides having different lengths are prepared and traverse drums having different wind numbers are combined to effect winding, whereby packages of various different winding widths can be simply obtained.

A second embodiment will be described below. A defining guide, defining the movement of a yarn to a side end of a traverse width changing member among traverse directions of a yarn when the traverse width changing member is moved out, is provided at the section via which the yarn is fed to a traverse drum containing the traverse width changing member movable in and out of a traverse groove, constitutes the yarn guide. Accordingly, even when the traverse width changing member is moved out to define a traverse width, stitching does not occur.

The second embodiment of present invention has the aforementioned configuration so that when the traverse changing member is not moved out, the yarn is traversed over the full length of the traverse groove to form a package having a long winding width. At that time, the defining guide at the portion of the yarn to be fed to the traverse drum is not used but normal operation is conducted. Then, when the traverse width changing member is moved out, the yarn is turned back from a portion of said member, and a package having a short winding width is formed. At that time, the defining guide is provided, and when the yarn is turned back from the traverse width changing member, the yarn which tends to fly out of the groove is defined by the defining guide.

Figure 3:
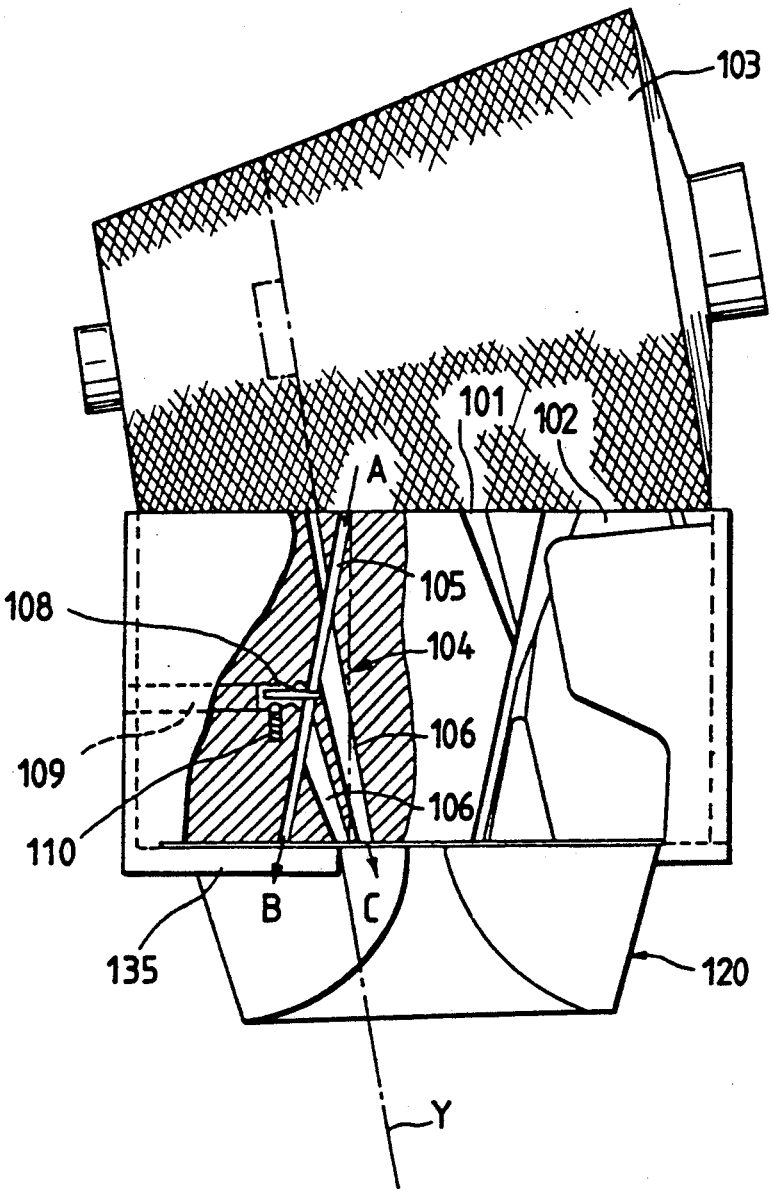
FIG. 3 is a front view showing another embodiment of the present invention partly in section.
Figure 4:
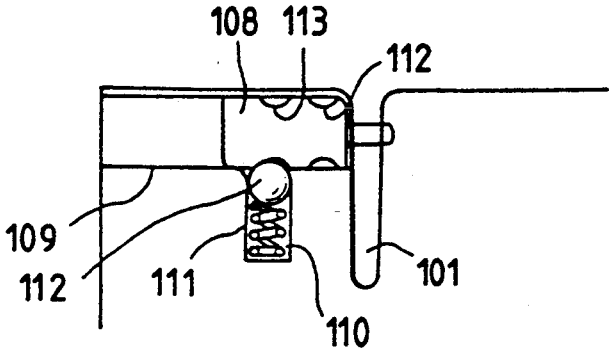
FIG. 4 is a longitudinal sectional view of a pin insert portion of a traverse drum in the embodiment shown in FIG. 3.
Figure 5:
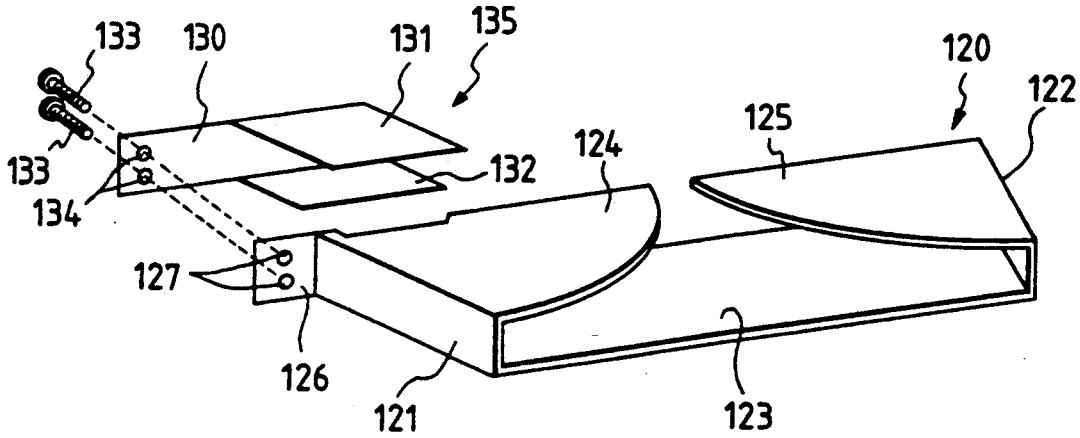
FIG. 5 is a perspective view of a defining guide portion in the embodiment shown in FIG. 3.

The second embodiment of the present invention will be described with reference to the drawings. The traverse drum 102 formed on the surface thereof with the traverse groove 101 is rotatably driven by an external source, and the package 103, which is in pressure contact therewith is rotated to thereby wind a yarn while performing traverse. At the intersection portion 104 of the traverse groove 101 of the traverse drum 102, a deep groove 105 and a shallow groove 106 are suitably formed so that the yarn does not cross the other traverse groove crossed therewith. In the intersection portion 104 located on the utmost left side in FIG. 3, a hole 109 for receiving the turn-back pin 108 which crosses the deep groove 105 and is moved in and out therefrom, is formed in an axial direction of the traverse drum 102. A hole 111 for receiving a spring 110 is provided perpendicularly to a hole 109. The turn-back pin 108 is formed in the outer periphery thereof with two engaging grooves 112 and 113, which are located when a ball 112 urged by the spring 110 is engaged with the engaging grooves 112 and 113. At the retreated position of the turn-back pin 108, the tip of the pin is not moved into the traverse groove 101, and accordingly, the yarn is guided to the intersection portion 104, in the direction indicated by arrow A, by the traverse groove 101, and moves straight along the intersection portion 104 in the direction indicated by arrow B. As a result, the yarn is guided and traversed by the traverse groove 101 formed on the surface of substantially the full length of the traverse drum 102 to form a long package, as indicated by the solid line.

The yarn guide 120 at the portion of the yarn Y fed into the traverse groove 101 is composed of left and right side plates 121, 122 for defining the traverse direction of yarn, a bottom plate 123 and left and right top plates 124 and 125 which extend so that they come close to each other, parallel with the bottom plate 123. This structure helps to minimize problems due to yarn scattering that occur when there is a yarn breakage. An outwardly extending projection 126, provided on the side plate 121 of the yarn guide 120, and tapped holes 127, 127 are provided. On the other hand, there is provided the defining guide 135, composed of a base plate 130 having a height of the yarn guide 120 and a predetermined length in a direction of defining the traverse width, tongues 131, 132 corresponding to the height of the yarn guide 120 and extended from the base plate 130, and tapped holes 134, 134 corresponding to the tapped holes 127, 127 of the yarn guide 120 at positions capable of being engaged by threads 133, 133.

In the above-described configuration, in forming a package having a long winding width, the turn-back pin 108 is not moved into the deep groove 105 as described above, nor is the defining guide 135 fitted in the yarn guide 120. Therefore, the yarn is traversed over the full length of the traverse groove to form a package having a long winding width. That is, a so-called 3-wind type package is formed, in which the traverse drum 102 is rotated three times and the yarn traverses once.

On the other hand, when a package having a short winding width is formed, the turn-back pin 108 is moved into the deep groove 105, the defining guide 135 is simultaneously fitted into the yarn guide 120, and the threads 133, 133 are engaged with the tapped holes 127, 127 and 134, 134 so that the defining guide 135 is secured to the yarn guide 120 to thereby cover an open end of the yarn guide 120. Thereby, the yarn guided in the direction indicated by A through the traverse groove 101 is defined in movement thereof in the direction indicated by B by the turn-back pin 108 to increase tension rightward in the figure at the turn-back portion and quicken the movement of the yarn at the turn-back portion whereby the yarn is turned back in the direction indicated by C of chain line to prevent stitching. As a result, a short package as shown by the chain line is formed. That is, a so-called 2-wind type package is formed, in which the traverse drum 102 is rotated twice and the yarn traverses once.

While in the above-described embodiment, the turn-back pin is used as a member for defining the traverse width, various means such as one in which a turn-back member is fixed by a screw can be also used.

The second embodiment of the present invention has the construction and function as described above.

While, packages produced by an automatic winder are processed such that the obtained packages are supplied to a doubling and twisting bed of a two for one twister to double and twist them to obtain yarns of higher class according purposes.

The applicant has previously proposed an arrangement in which an automatic winder and a two for one twister are connected, wherein in order to efficiently operate a two for one twister having an automatic winder and a doubling and twisting bed, a feed yarn package exchanger is provided between the automatic winder and the two for one twister in the next process so that packages being transported on a package carrying conveyor on the automatic winder side are inserted into the doubling and twisting bed in the two for one twister by said feed yarn package exchanger and transferred onto a tray conveyor (See Japanese Patent Laid Open No. 196470/1988 publication).

Figure 8:
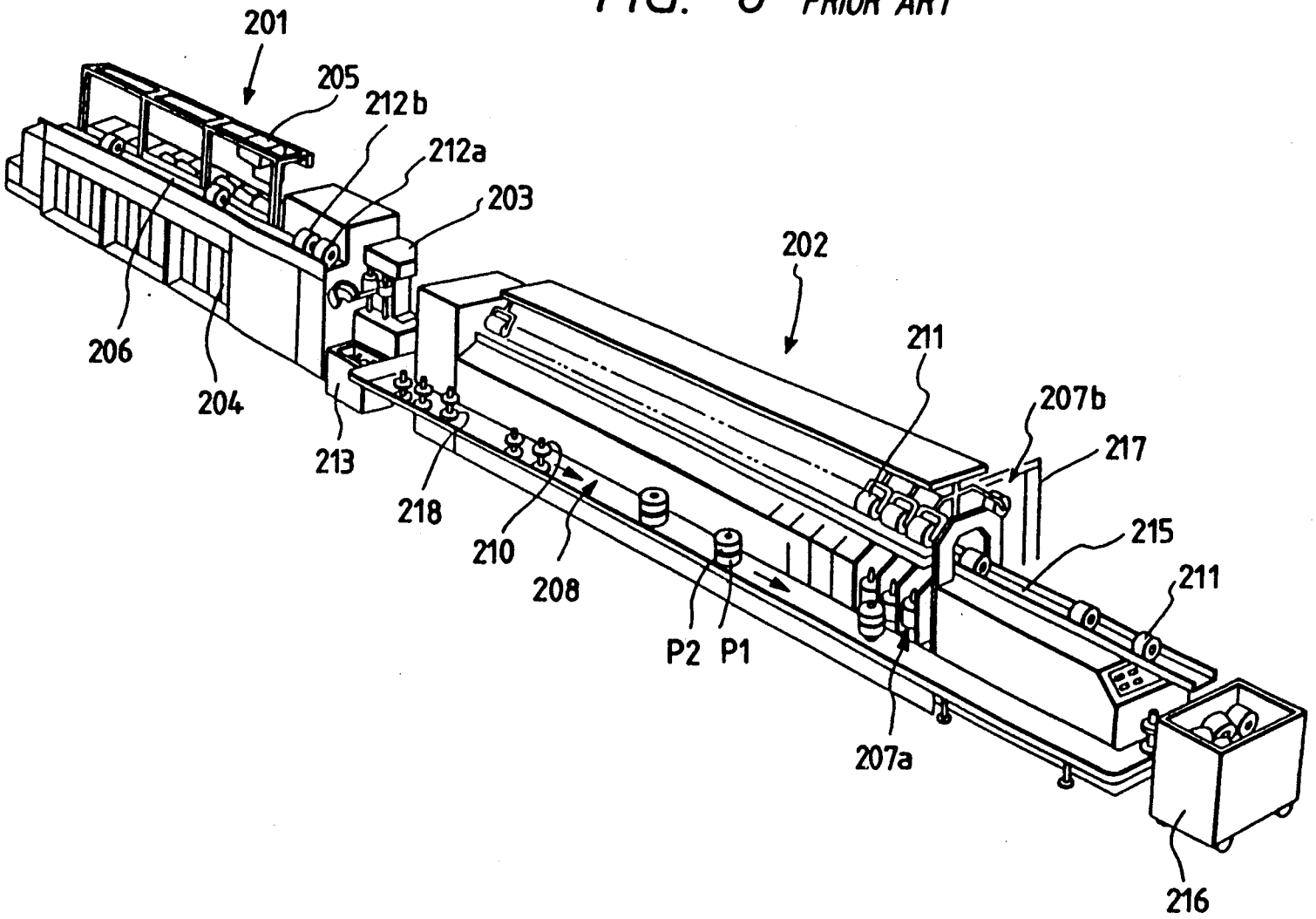
FIG. 8 PRIOR ART
FIG. 8 is a perspective view showing a conventional connecting system of an automatic winder and a two for one twister.

FIG. 8 shows the connecting system, in which an automatic winder 201 and a two for one twister 202 are directly connected through a feed yarn package exchanger 203. The automatic winder 201 is composed of a plurality of winding units 204. A package having a predetermined winding width produced by each winding unit is doffed by an automatic doffing carriage 205 movable along the units and is discharged onto a package carrying conveyor 206 laid along the units. On the other hand, the two for one twister 202 directly connected to the winder 201 has a number of spindles **207*a* and 207*b* arranged back to back, and a tray conveyor 208 for transporting packages is laid in the periphery of the frame in a closed loop fashion so that a tray is circulated. A doubling and twisting bed 18 (see FIG. 9) is placed on the tray of the tray conveyor 208. This doubling and twisting bed 18 is provided with a doubling and twisting bed containing two packages P1 and P2 (hereinafter referred to as a full doubling and twisting bed and another doubling and twisting bed and another doubling and twisting bed containing an empty take-up tube 210 (hereinafter referred to as an empty doubling and twisting bed which circulate randomly. A twisted yarn package 211 is discharged from a spindle having a finished package by an automatic doffing carriage 217 or an operator, and an empty doubling and twisting bed within a spindle is replaced by a full doubling and twisting bed on the tray conveyor to restart winding. The yarn feed package exchanger 203 is installed between the winder 201 and the two for one twister 202 so that take-up tubes 210 are successively removed from the empty doubling and twisting bed which is circulated on the tray conveyor 208, and feed yarn packages 212*a* and 212*b* being transported from the winder are successively inserted to form a full doubling and twisting bed. Reference numeral 213 denotes a take-up tube box which receives empty take-up tubes removed from the empty doubling and twisting bed. In the two for one twister 202 the twisted yarn package 211 doffed by the automatic doffing carriage 217 or an operator is delivered onto the conveyor belt 215 which travels between the spindles provided back to back, and received into a package receiving carriage 216 on the machine bed side. FIG. 8** shows an arrangement in which one automatic winder and one two for one twister are connected, but normally, one automatic winder and plural two for one twister are connected so as to balance quantities of production.

Next, a conventional doubling and twisting bed 218 used for a 6-inch cone-like package generally produced by an automatic winder will be described with reference to FIG. 9. The doubling and twisting bed 218 is composed of one tubular body 251 and an intermediate plate 252 and is placed on a tray 214 and circulated by a tray conveyor. The tubular body 251 is continuously composed of a flange portion 253, a conical portion 254, a straight portion 255 and an inlet guide portion 256. The intermediate plate 252 is continuously composed of a yarn guide portion 257 and a conical convex portion 258. A take-up tube 210 for a lower 6-inch cone-like package P1 is inserted into the cylindrical portion 254 of the tubular body 251, and a lower end of the take-up tube 210 is in contact with the flange 253. The intermediate plate 252 is fitted into the straight portion 255 of the tubular body 251 and in contact with the upper end of the take-up tube 210. The take-up tube 210 for an upper 6-inch cone-like package P2 is fitted into the conical convex portion 258 of the intermediate plate 252 to form a two-stage form.

Packages wound by the automatic winder are on one hand sold as they are, and on the other hand consumed in the next process. The case of sales normally comprises a reference, and a standard package wound by the automatic winder is a 6-inch cone. When 6-inch cone-like packages P1 and P2 are superposed in two stages as shown in FIG. 9, the back is high for a diameter of winding, and yarn breakages caused by defective release often occur. In view of this, it is contemplated that a package is formed in winding width of 4 inches on a take-up tube for a 6-inch cone (a 4-inch groove and a 6-inch groove which are different in depth are superposed and worked in a traverse drum with a groove of an automatic winder, and a pin is stood upright on a cross point to vary the groove into which yarn enters whereby switching between a winding width of 6 inch and a winding width of 4 inch can be freely conducted). However, when one automatic winder and one two for one twister are connected, it poses a problem that packages produced by the automatic winder are fixed and various packages cannot be produced by the automatic winder.

Figure 9:
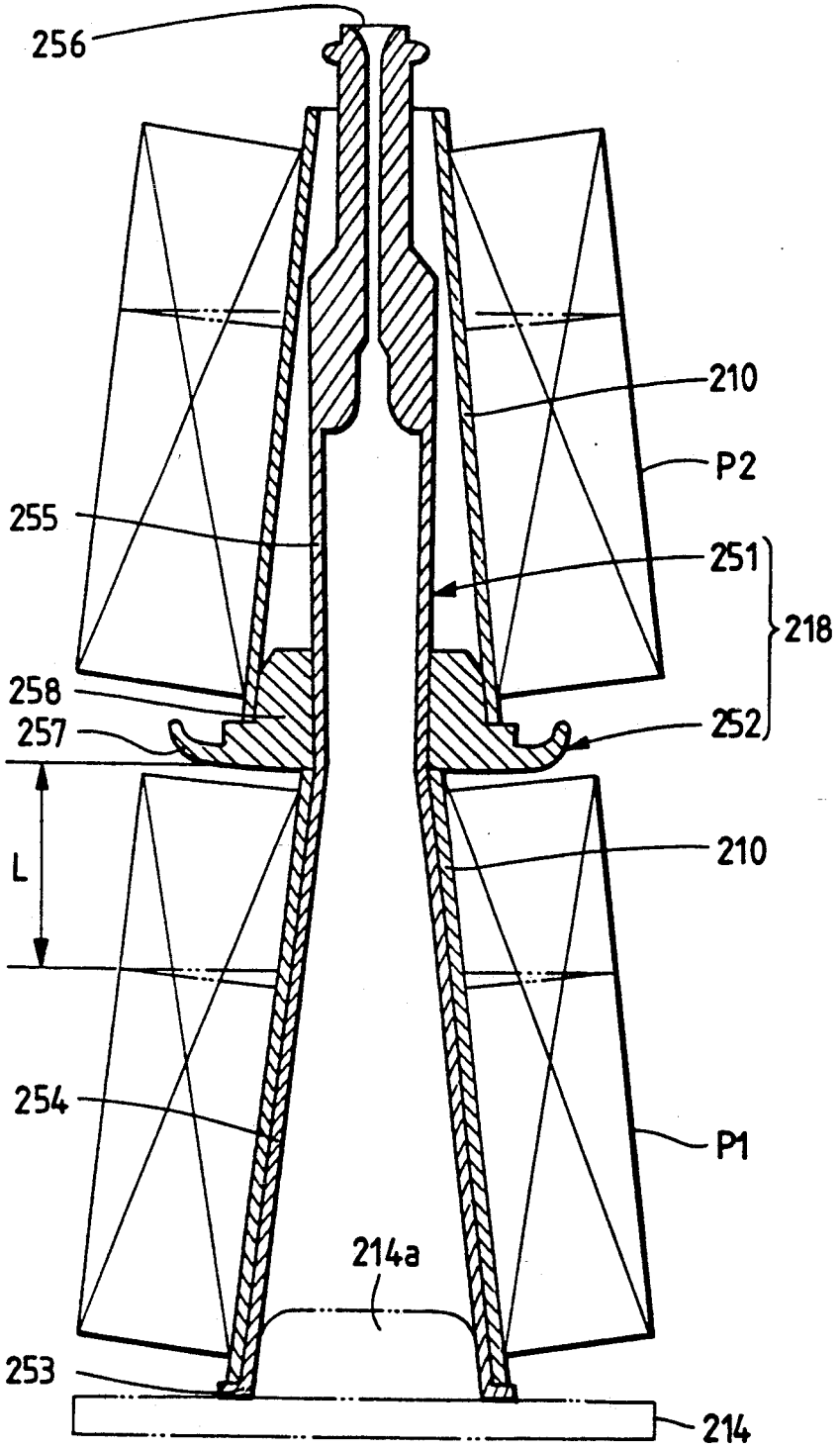
FIG. 9 PRIOR ART
FIG. 9 is a sectional view of a conventional doubling and twisting bed.

Further, in the conventional doubling and twisting bed, when a feed yarn package having a winding width of 4 inch is used for a take-up tube 10 for a 6-inch cone, the back of an upper feed yarn package P2 is lower, as indicated by dash-dotted contour lines in FIG. 9, but clearances L increase in the lower feed yarn package Pl, and an occurrence of yarn breakages cannot be sufficiently suppressed.

The present invention has been achieved in view of these problems noted above with respect to prior art. An object of the present invention is to provide a connecting system of an automatic winder and a two for one twister which can efficiently connect an automatic winder capable of switching a winding width of a package with a two for one twister for stacking packages in two upper and lower stages to effect twisting and doubling. A further object of the invention is to provide a doubling and twisting bed of a two for one twister in which cone-like packages having a narrow winding width can be stacked in two upper and lower stages so as to lower the back.

According to the present invention, there is provided a connecting system of an automatic winder and a two for one twister characterized in that an automatic winder capable of switching a winding width of a package and a two for one twister for producing twisted yarns are connected, and a single yarn processing line is connected to said automatic winder.

According to the present invention, there is further provided a doubling and twisting bed for a two for one twister characterized in that a doubling and twisting bed for supplying packages each formed in short winding width on the large diameter side of a take-up tube for a cone in the state where said packages are stacked in two upper and lower stages comprises a first tubular body into which is inserted a take-up tube of the lower stage package, and a second tubular body fitted into said first tubular body and into which is inserted a take-up tube of the upper stage package, and a space into which is moved a projection on the small diameter side of the lower stage take-up tube is provided at a lower portion of the second tubular body.

In the connecting system according to the present invention, packages having a normal winding width for sales in addition to packages having a narrow winding width required by a twisting machine are produced by an automatic winder to deliver them to a shipment and packing line via a single yarn processing line.

Further, in the doubling and twisting bed according to the present invention, by the provision of a space provided at a lower portion of the second tubular body and into which is moved a projection on the small diameter side of the lower stage take-up tube, the upper feed yarn package is stacked close to the lower feed yarn package wound in a short winding width on a long take-up tube.

An embodiment of a connecting system and a doubling and twisting bed of the present invention will be described hereinbelow with reference to the drawings. FIG. 6 is a view showing a connecting system of an auto winder and a two for one twister according to the present invention.

Figures 6A, 6B:
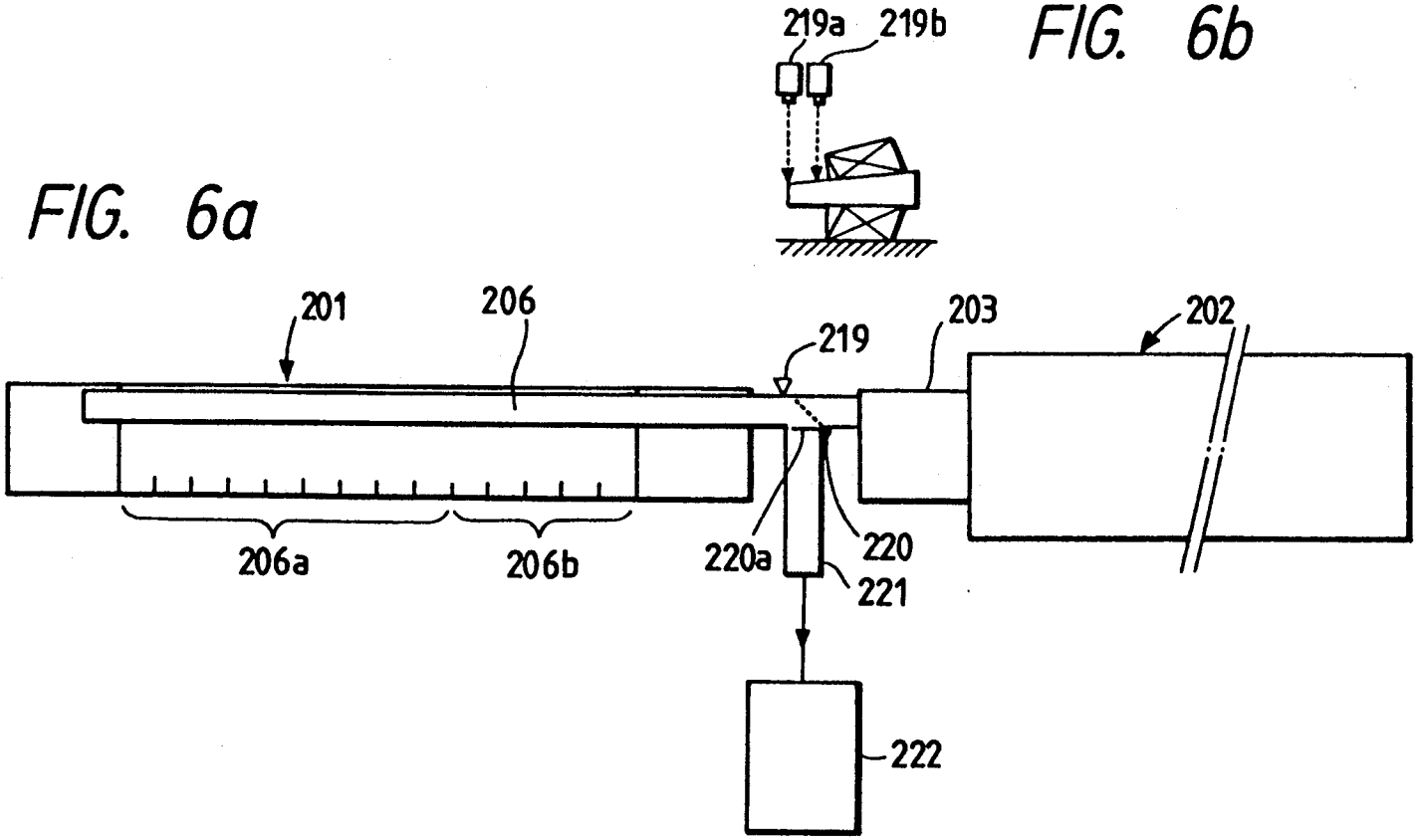
FIG. 6*a* is a view showing a connecting system of an automatic winder and a two for one twister.

In FIG. 6*a*, reference numeral 201 designates an automatic winder; 202 a two for one twister; 203 a feed yarn package exchanger; 206 a package carrying conveyor; 219 a package winding-width detecting device; 220 a switching device; 221 a branch conveyor; and 222 an inspecting and packing device.

The automatic winder 201 is divided into a winding unit 206*a* for a normal winding width for forming a package having a winding width of 6 inch on a take-up tube for a 6-inch cone, and a winding unit 6*b* for a narrow winding width for forming a package having a winding width of 4 inch on a take-up tube for a 6-inch cone. Packages having a normal winding width and packages having a narrow winding width are carried by a package carrying conveyor 6 in a mixed manner. The package winding-width detecting device 219 has two photoelectric switches 219*a* and 219*b*, for example, which can discriminate a package having a narrow winding width (See FIG. 6*b*). This package winding-width detecting device 219 is connected to the switching device 220 having an arm 220*a*, and a package having a narrow winding width is introduced into the feed yarn package exchanger 203 by the arm 220*a* at a position indicated by the solid line. A single yarn having a normal winding width is branched into the branch conveyor 221 as a single yarn processing line by the arm 220*a* at a position indicated by the dotted line.

According to the aforementioned connecting system, one automatic winder 201 and one two for one twister 202 can be connected to produce a variety of products in a small quantity, packages for shipment can be wound by winding units of extra automatic winders, and one automatic winder 201 and one two for one twister 202 can be efficiently connected. It is noted that the winding unit 206*a* may be directly connected to the branch conveyor 221 and the winding unit 206*a* may be directly connected to the feed yarn package exchanger 203 other than an arrangement wherein the automatic winder 201, the two for one twister 202 and the branch conveyor are connected with the package winding-width detecting device 219 through the switching device 220.

Figure 7:
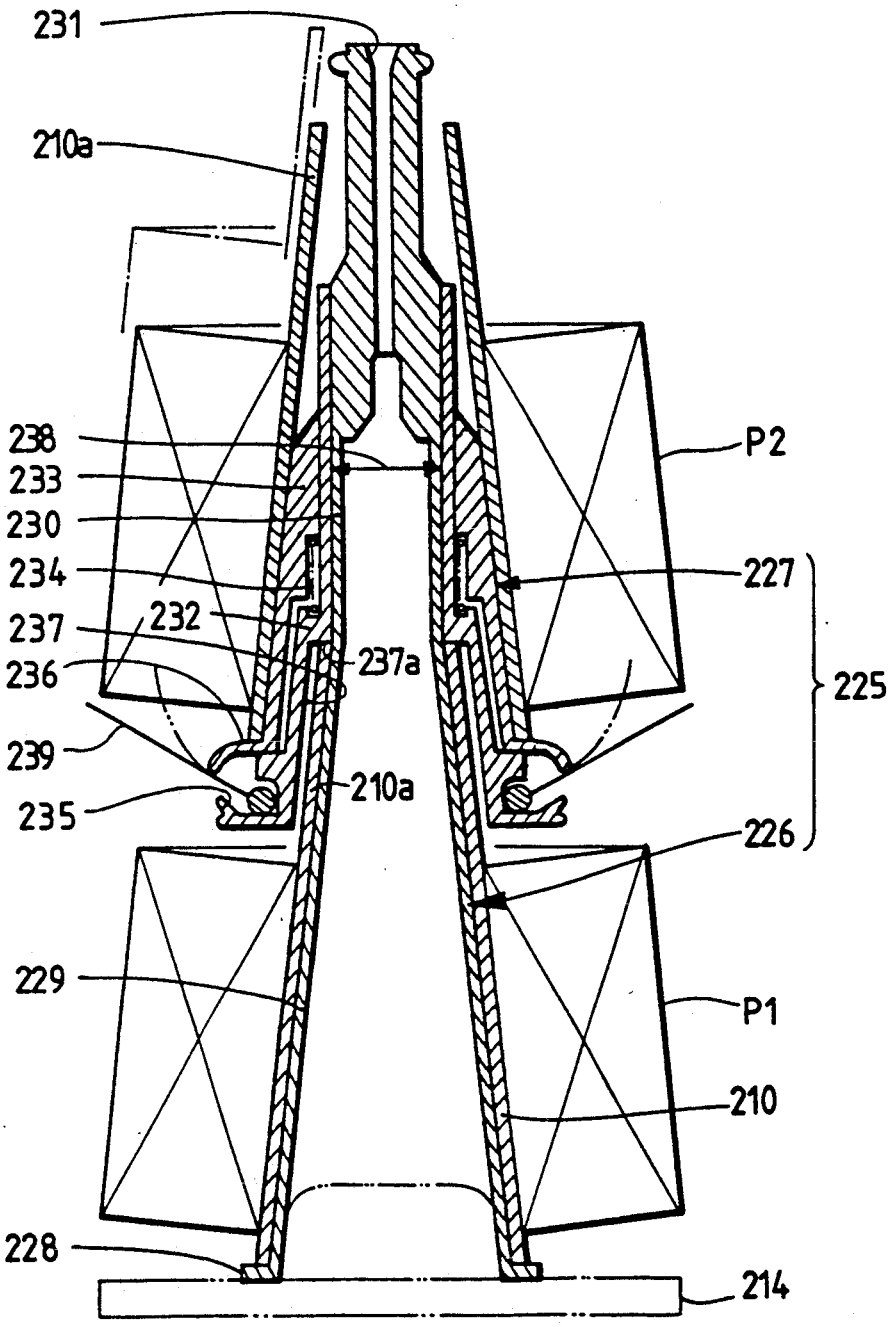
FIG. 7 is a sectional view of a doubling and twisting bed according to the present invention.

Next, the doubling and twisting bed according to the present invention will be described with reference to FIG. 7. This doubling and twisting bed 225 is composed of a first tubular body 226 and a second tubular body 227. The first tubular body 226 is continuously provided with a flange portion 228, a conical portion 229, a straight portion 230 and an inlet guide portion 231. The second tubular body 227 has a spring 234 interposed between a stationary tube 232 and an elevating tube 233 loosely fitted in said stationary tube 232. A receiving portion 235 for a shock absorber 239 is formed below the stationary tube 232, and a flange portion 236 is formed below the elevating tube 233. The stationary tube 232 is provided internally and downwardly thereof with a conical hole space 237, and the elevating tube 233 is provided internally thereof with an insert hole 238. Packages P1 and P2 having a 4-inch winding width are formed on the large diameter side of a 6-inch take-up tube 210, and a projection 210*a* in which a yarn layer is not present is formed on the small diameter side of the take-up tube 210. The take-up tube 210 of the lower 6-inch cone-like package P1 is inserted into the conical portion 229, and the lower end of the take-up tube 210 is in contact with the flange 228. The second tubular body 227 is fitted into the straight portion 230 of the first tubular body 226, and the upper end of the lower take-up tube is in contact with a shoulder 237*a* of the conical hole space 237, the second tubular body 227 being lowered and stopped. Accordingly, most of the projection 210*a* of the lower take-up tube 210 is plunged into the conical hole space 237. The upper 6-inch cone-like package P2 is inserted into the elevating tube 233 of the second tubular body 227, and the lower end of the take-up tube 210 is in contact with the flange portion 236. The shock absorber 239 is formed by bending nylon gut, which are then superposed in a petal form. This can be narrowed as indicated by dash-dotted contour lines, which comprises a buffer against tangling of released yarn to reduce yarn breakages. When the upper package P is lightened while being released, the elevating tube 233 is moved up by the bias of the spring 234 to assume a position indicated by dash-dotted contour lines so that the shock absorber 239 can be sufficiently narrowed.

The operation of the aforementioned carrier will be described below. In a package wound in 4-inch width by the automatic winder in which a cone-like 6-inch take-up tube is used as a standard, a small diameter side of the take-up tube 210 constitutes the projection 210*a*. However, in the case where take-up tubes are stacked in two stages as shown, the projection 210*a* of the lower take-up tube 210 is plunged into the space 237 of the second tubular body 227, which is apparently the same height as the case where 4-inch take-up tubes are stacked in two stages. Accordingly, a stacked height adjusted to a winding diameter of a package is provided to suppress frequent occurrence of yarn breakage.

In a connecting system of an automatic winder and a two for one twister according to the present invention, an automatic winder capable of switching a winding width of a package and a two for one twister for performing doubling and twisting are connected, and a single yarn processing line is connected to the automatic winder. Packages having a narrow winding width required by the two for one twister and packages having a normal winding width for sales can be produced in a mixed manner by the automatic winder or the packages for sales can be exclusively produced, and both of them can be efficiently connected.

Furthermore, a doubling and twisting bed of a two for one twister comprises a first tubular body into which is inserted a take-up tube of the lower stage package and a second tubular body fitted into the first tubular body and into which is inserted a take-up tube of the upper stage package, a space being provided into which is moved a projection on the small diameter side of the lower stage take-up tube at a lower portion of the second tubular body. The upper stage feed yarn package is stacked close to the lower stage feed yarn package wound in short winding width on the long take-up tube. Therefore, for example, even in the case where feed yarn packages produced by the automatic winder in which a 6-inch cone is used as a standard are stacked in two stages to effect doubling and twisting, a stacked height can be lowered as compared with a winding diameter of a package to suppress an occurrence of end breakages.

What is claimed is:

1. A method for winding yarn onto a package, the package having a width, the method comprising:

providing a traverse drum, providing a yarn guide, guiding yarn through the yarn guide to the traverse drum, providing a defining guide, detachably mounting the defining guide on the yarn guide to that the defining guide limits movement of yarn guided to the traverse drum in at least one direction to thereby define the width of the package.

2. A yarn winding apparatus for winding yarn onto a package, the package having a width, the apparatus comprising:

a traverse drum, a yarn guide for guiding yarn to the traverse drum, a defining guide configured to be detachably mounted on the yarn guide for limiting movement of yarn guided to the traverse drum in at least one direction to thereby define the width of the package.

3. The apparatus of claim 2, wherein the yarn guide defines an exterior and wherein the defining guide comprises:

an upper plate defining a first end, a second end, and opposing sides, the first end of the upper plate defining a mounting member for detachably mounting the defining guide to the yarn guide and the second end of the upper plate defining a recess, and a side plate attached to at least one of the opposing sides of the upper plate, the defining guide being configured to cover at least a portion of the exterior of the yarn guide when the defining guide is mounted on the yarn guide and the recess of the upper plate being configured to define at least a portion of a traverse path for the yarn when the defining guide is mounted on the yarn guide.

4. A yarn winding apparatus comprising a traverse drum having a traverse groove, a traverse width changing member configured for moving in to and out of the traverse groove, a yarn guide for guiding yarn to the traverse drum, a defining guide configured to be detachably mounted on the yarn guide for limiting movement of yarn guided to the traverse drum when the traverse width changing member is moved in to the traverse groove.

5. The apparatus of claim 4, wherein the traverse drum defines an axial direction, a deep groove, and an intersection portion at which the traverse groove and the deep groove intersect and wherein the traverse width changing member comprises a moveable turn-back pin configured for crossing the deep groove and for moving in to and out of the deep groove at the intersection portion, the traverse drum defining a hole formed in the axial direction of the traversed drum for receiving the turn-back pin, and further comprising engagement means for fixing the position of the turn-back pin relative to the deep groove.

6. The apparatus of claim 4, wherein the yarn guide comprises:

a pair of side plates configured to define at least a portion of a traverse path for the yarn, a bottom plate, and a pair of top plates disposed substantially parallel to the bottom plate, and wherein the defining guide comprises at least one tongue configured to define at least a portion of a traverse path for the yarn when the defining guide is mounted on the yarn guide.

* * * * *